United States Patent [19]

Isaacks

[11] 4,211,279

[45] Jul. 8, 1980

[54] PLUNGER LIFT SYSTEM

[75] Inventor: Kenneth M. Isaacks, North Glenn, Colo.

[73] Assignee: Otis Engineering Corporation, Dallas, Tex.

[21] Appl. No.: 971,537

[22] Filed: Dec. 20, 1978

[51] Int. Cl.[2] ..... E21B 43/00; E21B 43/16

[52] U.S. Cl. ..... 166/64; 166/53; 166/70; 166/106; 166/314; 417/58

[58] Field of Search ..... 417/58, 57, 56; 166/314, 70, 53, 83, 64, 65 R, 72, 75 R, 105, 106

[56] References Cited

U.S. PATENT DOCUMENTS

| | | | |
|---|---|---|---|
| 2,762,308 | 9/1956 | Tomlinson | 417/58 |
| 3,028,815 | 4/1962 | Canalizo et al. | 417/57 |
| 3,031,971 | 5/1962 | Roach | 417/57 |
| 3,039,394 | 6/1962 | Brown et al. | 417/57 |
| 3,064,628 | 11/1962 | Canalizo et al. | 121/48 |
| 3,090,316 | 5/1963 | Montgomery | 417/58 X |
| 3,095,819 | 7/1963 | Brown et al. | 417/57 |
| 3,147,808 | 9/1964 | McCarvell et al. | 417/57 X |
| 3,233,472 | 2/1966 | Canalizo et al. | 74/30 |
| 3,351,021 | 11/1967 | Moore, Jr. | 417/57 |
| 3,424,066 | 1/1969 | Moore, Jr. | 92/193 |

OTHER PUBLICATIONS

Harold Brown Co., Inc., Production Equipment, Technical Manual, 1956, pp. 23–25.

Otis Engineering Corp. Gas Lift Equipment and Services Catalog, (OEC5122), pp. 36, 37.

*Primary Examiner*—Stephen J. Novosad

*Attorney, Agent, or Firm*—Thomas R. Felger

[57] ABSTRACT

A plunger lift system used in wells having a tubing string disposed within casing. An improved plunger catcher and trip assembly is provided within the wellhead to hold the plunger in its upper position while lift gas escapes from the tubing string through the wellhead and formation fluids form a new slug in the lower end of the tubing string. The new system incorporates a conventional mechanical timer or controller to allow simple adjustments to obtain the most efficient product rate from each individual well. The controller determines the time interval during which lift gas is injected into the annulus between the casing and tubing and the time interval during which the plunger is held within the wellhead by the catcher and trip assembly.

6 Claims, 3 Drawing Figures

PLUNGER LIFT SYSTEM

BACKGROUND OF THE INVENTION

1. Field of the Invention

When the energy of an oil and gas reservoir is partially depleted, gas lift techniques are frequently used to raise the formation fluids to the well surface. The theory and design of various gas lift installations is fully explained in GAS LIFT THEORY AND PRACTICE by Kermit E. Brown, published in 1967 by Prentice-Hall, Inc. Intermittent gas lift of liquid slugs of formation fluid is theoretically a very efficient method of secondary recovery. However, the gas, propelling the liquid slug up the tubing string, will penetrate the liquid slug and allow the liquid to fall back in the tubing as droplets or film on the tubing wall. One method commonly used to improve the efficiency of intermittent gas lift and reduce fall back is to install a plunger to separate the liquid slug from the propelling gas.

Free piston or plunger pumping apparatus has been used in the petroleum industry for many years. The plunger or free piston is propelled by gas through a production tubing string communicating with an underground hydrocarbon formation to the well surface, pushing a liquid slug ahead of it. The propelling gas may be supplied from the formation or by injecting gas from the well surface to a location intermediate the production tubing string.

2. Description of the Prior Art

Plunger lift or free piston pumping systems commonly have a vertical section of pipe and associated fittings called a lubricator forming a part of a wellhead. A string of production tubing extends below the wellhead to an underground hydrocarbon formation or producing zone with the lubricator and production tubing having a common bore. The wellhead has various outlets for communicating fluids.

The plunger generally has a longitudinal opening and a valve designed to open and closes the opening. Preferably, the valve is operated by a bumper at the top of the lubricator and a similar bumper supported within the tubing string near the lower end thereof. When the valve is open, gas and liquid can freely pass through the plunger allowing the plunger to fall through the production tubing until it contacts the lower bumper and the valve is shut. Gas pressure, injected into the tubing from the annulus between the tubing and casing, forces the piston up and the tubing lifting a slug of liquid. Various devices have been used to catch the plunger within the lubricator while formation fluids accumulate in the production tubing to form another slug and to control the injection of gas into the annulus between the tubing and casing and from the annulus into the tubing below the plunger.

U.S. Pat. No. 3,095,819 to Norman F. Brown discloses a free piston pumping system having a controller which responds to the presence of the plunger in the lubricator to open and shut a valve in the outlet from the wellhead and to actuate a catcher to trap the plunger within the lubricator.

U.S. Pat. No. 3,031,971 to Erskine E. Roach discloses a system similar to U.S. Pat. No. 3,095,819 which has a magnetic actuating device to sense the presence of the plunger within the lubricator.

U.S. Pat. No. 3,351,021 to E. K. Moore, Jr. discloses a system similar to the two above systems having an improved pneumatic shock absorber in the lubricator to arrest the plunger movement and a pneumatic sensor to detect the presence of the plunger within the lubricator. The pneumatic sensor triggers a mechanical timer which controls the outlet valve and a catcher which releases the plunger from the lubricator.

None of the above patents disclose the use of a plunger catcher and trip assembly which is actuated by the same controller that controls the injection of gas into the annulus between the production tubing and casing. None of the above patents disclose using the controller in the gas supply line to control the plunger. Rather, the above prior art systems rely upon the plunger to actuate the various components of each system.

A technical manual prepared in 1956 by Harold Brown Company, Houston, Texas, on page 25 discloses the use of an H. B. Type B-1 controller in the gas supply line to regulate the injection of gas into the production tubing string below the plunger. However, the B-1 controller is actuated by a magnetic switch which senses the presence of the plunger within the lubricator.

SUMMARY OF THE INVENTION

The present invention comprises an improved plunger lift system for use in a well having a wellhead, a tubing string disposed within a casing forming an annulus therebetween, lift gas supplied at the well surface, and means for injecting the lift gas from the well surface to within the bore of the tubing string at a location intermediate the ends of the tubing string, and a plunger adapted to reciprocate within the bore of the tubing string to separate lift gas from a liquid slug within the tubing string, wherein the improvement comprises means for catching and holding the plunger within the wellhead after the plunger has completed an upward stroke through the bore of the tubing string, a timer controller regulating the interval during which lift gas is injected from the source to the annulus, and the same timer controller regulating the interval during which the plunger is held within the wellhead.

One object of this invention is to provide a novel combination of timer controller, plunger catcher and trip assembly and a means for injecting gas to maximize the efficient use of lift gas in a plunger lift system for oil and gas wells.

Another object of this invention is to provide a plunger catcher and trip assembly which will hold a plunger within a wellhead for a preselected time interval.

Another object of this invention is to provide a combination of timer controller and plunger catcher and trip assembly which will hold a plunger within a wellhead upon completion of the upward stroke of the plunger.

It is still another object of this invention to provide an improved plunger lift system which controls the production of formation fluids to the well surface by regulating the supply of lift gas.

Still another object of this invention is to provide a plunger catcher and trip assembly with a minimum number of moving seals and the seals being easily replaceable upon leakage.

Other objects and advantages of this invention will be readily apparent to those skilled in the art from the following written description in conjunction with the accompanying drawings.

BRIEF DESCRIPTION OF THE DRAWINGS

In the drawings, like numerals indicate like parts and illustrative embodiments of the present invention are shown.

BRIEF DESCRIPTION OF THE PREFERRED EMBODIMENT

Figure 1:
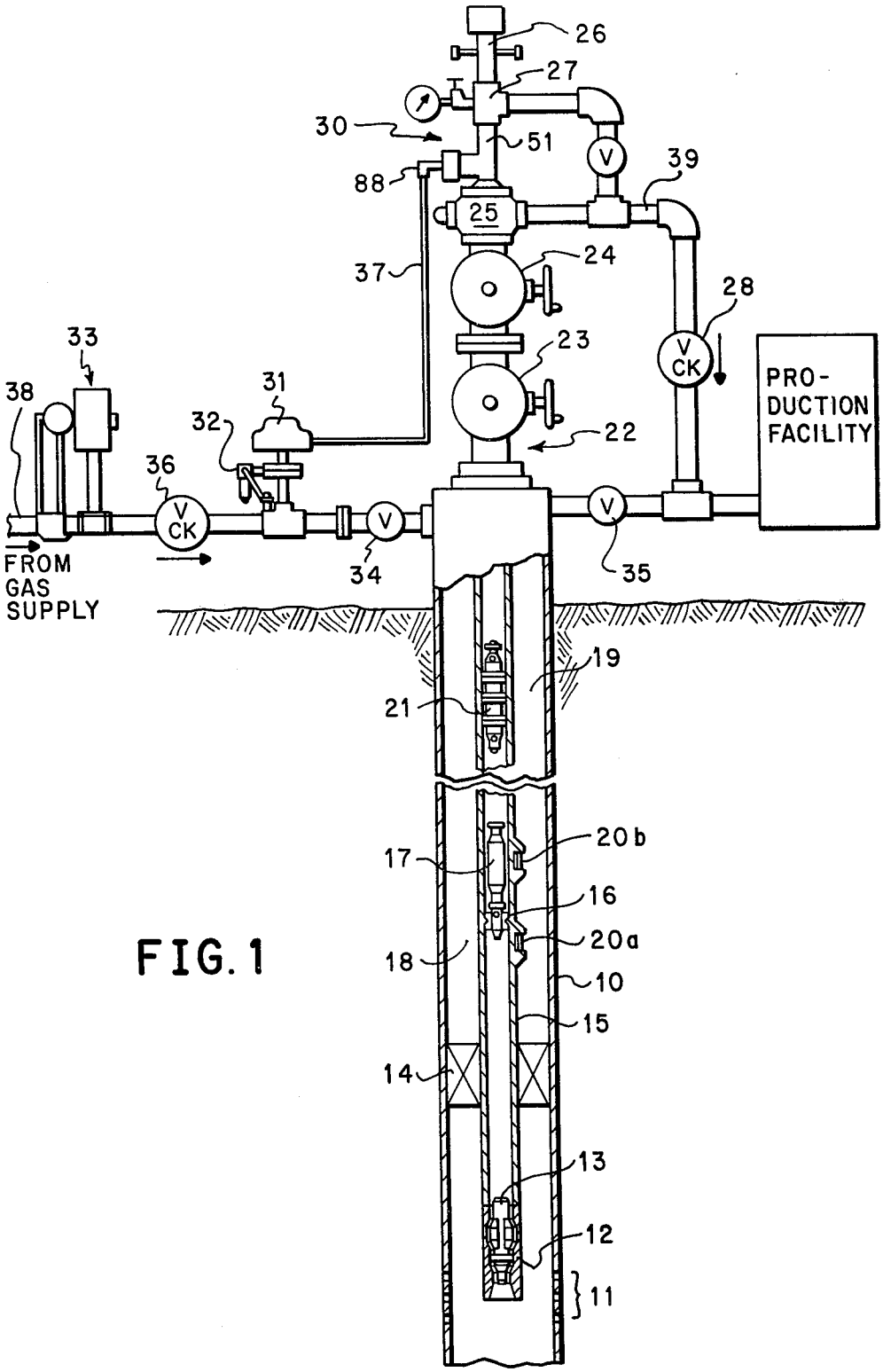
FIG. 1 is an elevational view, partially in section showing a well with the plunger lift system of the present invention.

Referring to the drawings and particularly FIG. 1, an improved plunger lift system for raising a liquid slug from a producing formation (not shown) to a production facility is disclosed. The system comprises a casing 10 with perforations 11 adjacent to a hydrocaron producing formation or zone (not shown) and disposed within a well bore. Tubing string 15 is disposed within casing 10 and connected to wellhead 22 at the well surface. Production packer 14 provides an annular seal between casing 10 and tubing 15 above perforations 11. A receiving means such as no go nipple 12 is frequently installed at the lower end of tubing 15 to anchor a check valve or standing valve 13 therein. Production packer 14 directs fluids entering casing 10 through perforations 11 into the lower end of tubing 15. Standing valve 13 allows upward fluid flow into the bore of tubing 15 through nipple 12 and prevents fluid flow in the reverse direction out of the lower end of tubing 15 when the bore of tubing 15 is pressurized by lift gas.

Plunger or free piston 21 is shown slidably disposed within the bore of tubing 15. The downward movement of plunger 21 is limited by bumper spring 17 setting on tubing stop 16. Plunger 21 may be any device compatible with tubing 15. One such plunger is shown in U.S. Pat. No. 3,424,066 to E. K. Moore, Jr. which is incorporated by reference for all purposes in this written description. The upward movement of plunger 21 is limited by lubricator bumper sub 26 attached to the upper portion of wellhead 22.

Wellhead 22 is supported at the well surface by casing 10 with outlets for communicating formation fluids to a production facility. The bore of tubing 15 is aligned with the bore of lubricator bumper subassembly 26 and plunger catcher and trip assembly 30 through wellhead 22. Plunger catcher and trip assembly 30 can be activated to hold plunger 21 within wellhead 22 as later described herein.

An annulus 18 is formed between tubing 15 and casing 10. The upper end of annulus 18 is sealed by wellhead 22. Production packer 14 seals between casing 10 and tubing 15 intermediate the ends thereof to form a gas chamber 19 within annulus 18. At the well surface, conduit 38 is connected to casing 10 to supply lift gas to annulus 18 and to charge chamber 19 with gas. The flow of lift gas through conduit 38 is regulated by motor valve 32 which is opened and closed by timer controller 31. A motor valve satisfactory for use with the present invention is shown in Otis Engineering Corporation Gas Lift Equipment and Services Catalog (OEC5122) page 37. An automatic timer controller satisfactory for use in the present invention is shown on page 36 of the same catalog. U.S. Pat. No. 3,064,628 and U.S. Pat. No. 3,233,472 to C. R. Canalizo, et al disclose the operation of gas powered timers. U.S. Pat. No. 3,028,815 to C. R. Canalizo discloses the use of a motor valve to intermittently regulate the injection of lift gas into a well. U.S. Pat. Nos. 3,028,815; 3,064,628; and 3,233,472 are incorporated by reference for all purposes in this written description.

Figure 2:
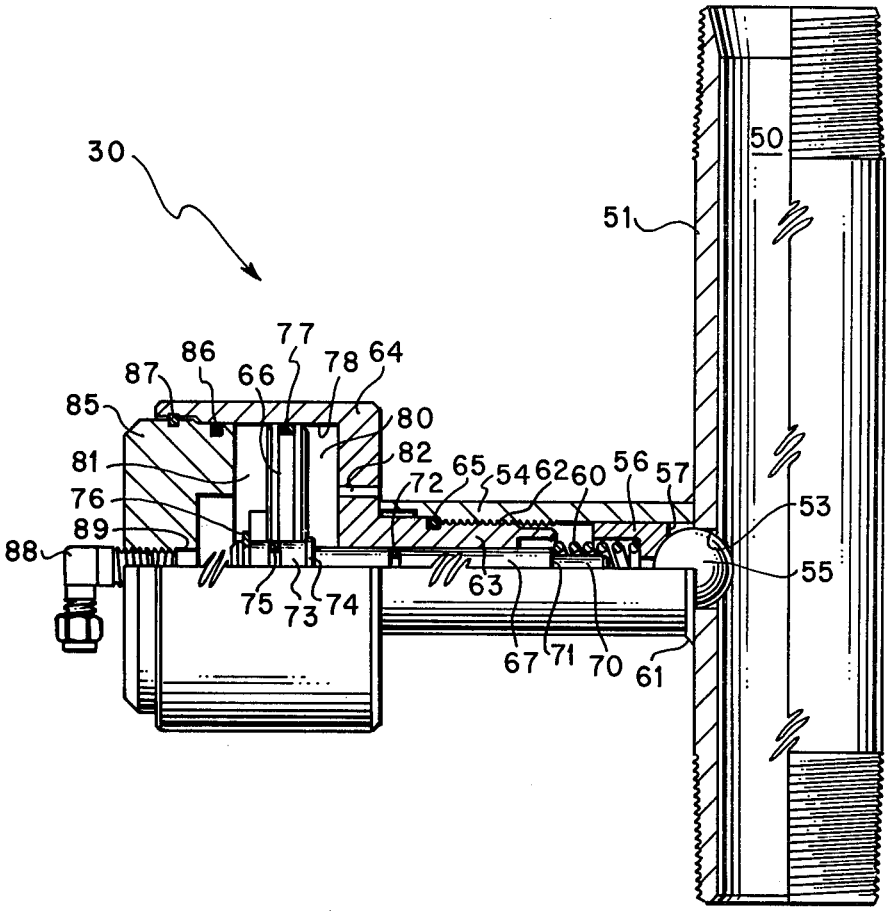
FIG. 2 is a view partially in section and partially in elevation of the catcher and trip assembly of the present invention.

Referring to FIG. 2, a plunger catcher and trip assembly 30 is shown having a tubular means 51 with a longitudinal bore 50 therethrough. Each end of tubular means 51 has threads 52 to secure catcher and trip assembly 30 within wellhead 22 and align bore 50 with the bore of tubing 15. An aperture or opening 53 is formed in the wall of tubular means 51. Housing 54 extends radially from tubular means 51 and surrounds opening 53. Ball 55 is shown partially disposed within housing 54 and partially extending through opening 53 into bore 50. The portion of ball 55 within bore 50 provides a means for engaging plunger 21 and holding plunger 21 within tubular means 51 until ball 55 is allowed to retract from opening 53. A ball retainer 56 is slidably disposed within housing 54 with one end 57 formed to abut ball 55. Ball retainer 56 is generally cylindrical in shape with an opening opposite end 57 large enough to receive spring 60 within retainer 56. Housing 54 surrounds opening 53 and is held in fluid tight engagement with tubular means 51 by weld 61.

Threads 62 are formed on the inside diameter of housing 54 near the end opposite tubular means 51. Threads 62 engage similar threads formed on the outside diameter of protrusion 63 which is part of piston housing 64. O-ring 65 is carried on protrusion 63 and forms a fluid tight seal between housing 54 and piston housing 64 adjacent threads 62. O-ring 65 is a static seal when threads 62 are made up which reduces the possibility of seal failure. Piston housing 64 cooperates with housing 54 to form a housing means for piston 66 and operating shaft 67.

Operating shaft 67 is slidably disposed within the bore of protrusion 63 and housing 54. One end of operating shaft 67 has a reduced diameter 70 which forms shoulder 71 to receive spring 60. Therefore, shoulder 71 and ball retainer 56 hold spring 60 in compression. When operating shaft 67 is moved to its first position closest to tubular means 51, operating shaft 67 fully compresses spring 60, engages ball retainer 56 and holds a portion of ball 55 projecting through opening 53. As previously described, the portion of ball 55 will then hold plunger 21 within bore 50. When operating shaft 67 is moved to its second position farthest from tubular means 51, ball 55 can retract from opening 53 slightly compressing spring 60 and releasing plunger 21 from bore 50. O-ring 72 is carried on operating shaft 67 and forms a fluid tight seal with the inside diameter of protrusion 63. Therefore, well fluids within bore 50 are prevented from escaping to the atmosphere by static seal 65 and moving seal 72. As later described, both seals can be easily replaced if either should start to leak.

Piston 66 is mounted on the other end of operating shaft 67 opposite reduced diameter portion 70. Operating shaft 67 has an enlarged diameter portion 73 with shoulder 74 formed thereon. Piston 66 has a concentric opening machined to fit over enlarged diameter 73 but not shoulder 74. O-ring 75 is carried on the exterior of enlarged diameter portion 73 to form a fluid tight seal between the concentric opening in piston 66 and operating shaft 67. O-ring 75 is a static seal. Snap ring 76 engages a groove machined in the outsided diameter of enlarged portion 73 opposite shoulder 74 to securely attach piston 66 to operating shaft 67.

Piston 66 carries O-ring 77 on its outside diameter to form a fluid tight seal with the inner wall 78 of piston housing 64. O-ring 77 provides a movable seal which allows piston 66 to divide piston housing 64 into two variable volume chambers 80 and 81.

Chamber 80 is formed between piston 66 and the end of piston housing 64 from which protrusion 63 projects. Drilled passage 82 through housing 64 allows chamber 80 to freely communicate with the atmosphere. Therefore, chamber 80 is always at atmospheric pressure.

End cap 85 is a circular closure which seals the end of piston housing 64 opposite protrusion 63. O-ring 86 provides a static seal between end cap 85 and inner wall 78. Snap ring 87 holds end cap 85 secured to piston housing 64.

Upon failure of seal 86, 77, 75, or 72, end cap 85 can be easily removed, piston 66 and operating shaft 67 withdrawn from the housing means and the damaged O-ring replaced. Failure of seal 65 can be easily repaired by disengaging threaded connection 62 and replacing O-ring 65.

Variable volume chamber 81 is formed between piston 66 and end cap 85. Threaded pipe fitting 88 engages passageway 89 through end cap 85 to admit operating fluid to chamber 81. Preferrably, gas supplied from timer controller 31 through conduit 37 is used to pressurize chamber 81. However, other fluids could be used to operate piston 66 and operating shaft 67.

When chamber 81 is pressurized to a preselected value, the force on piston 66 will cause operating shaft 67 to move to its first position and compress spring 60 holding ball 55 partially projected through opening 53. When the pressure in chamber 81 is released, spring 60 will move operating shaft 67 to its second position allowing ball 55 to retract from opening 53.

Figure 3:
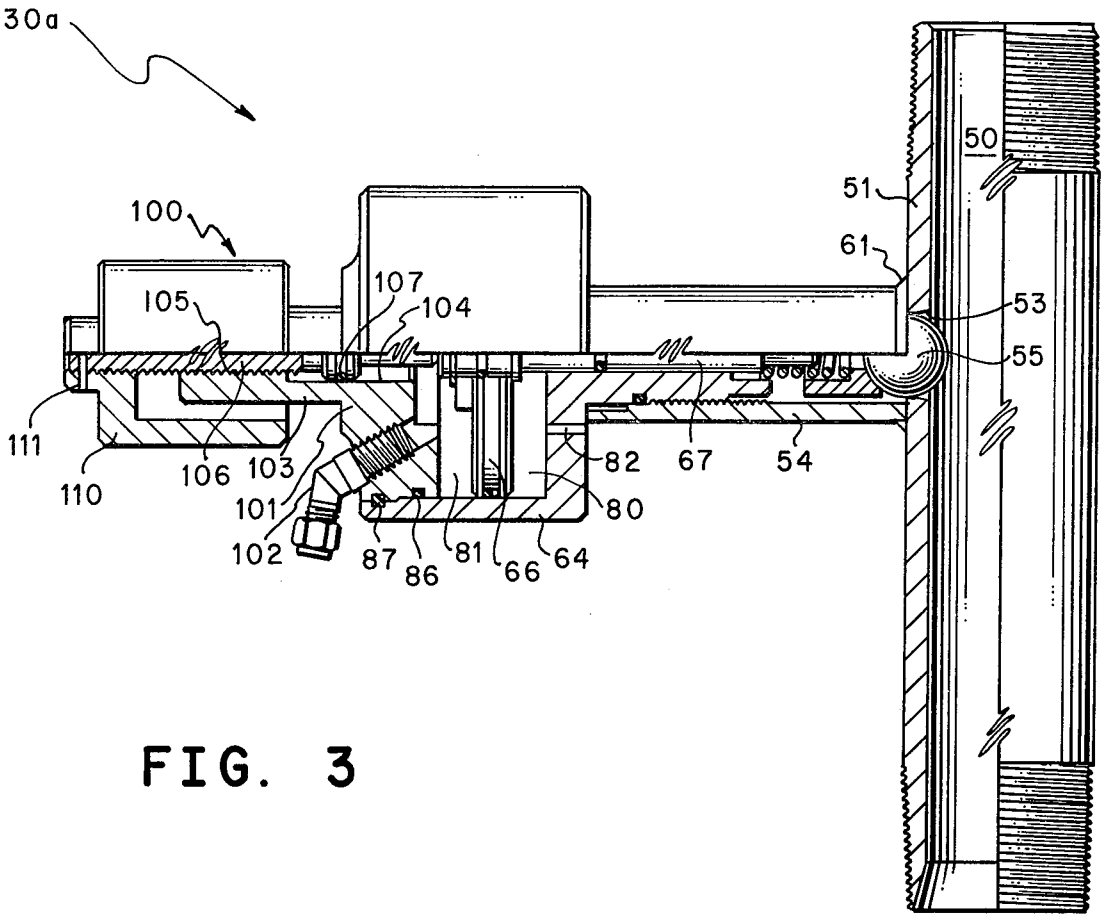
FIG. 3 is a view partially in section and partially in elevation of the catcher and trip assembly of the present invention incorporating a manual override feature.

FIG. 3 shows a plunger catcher and trip assembly 30*a* which operates similar to assembly 30 shown in FIG. 2 except assembly 30*a* has a mechanical override 100 which allows ball 55 to be held partially projecting through opening 53 without regard to the pressure in chamber 81.

End cap 101 is secured to piston housing 64 by snap ring 87. Operating fluid is admitted to chamber 81 through end cap 101 by threaded pipe fitting 102 which is offset from the location of threaded pipe fitting 88 in end cap 85. End cap 101 has a neck 103 projecting outward therefrom and concentric with opening 104. Neck 103 is internally threaded at 105 to receive stem 106. O-ring 107 is carried on the exterior of stem 106 to form a fluid tight seal with opening 104. Stem 106 is threaded to engage neck 103 at 105. Cap screw 110 is engaged by pin 111 with the end of stem 106 protruding from neck 103. Rotation of screw cap 110 rotates stem 106 which is translated into longitudinal movement of stem 106 through opening 104 by threads at 105. The end of stem 106 opposite cap screw 110 is contained within chamber 81 and adapted to engage operating shaft 67. When stem 106 is fully inserted through opening 104, operating shaft 67 is mechanically held in its first position so that ball 55 can hold plunger 21 within bore 50 even though chamber 81 was depressurized.

Operating Sequence

Plunger lift is a cyclic production method in which a liquid slug is first allowed to build up in production tubing string 15. In the present invention, gas is supplied from a source (not shown) at the well surface to lift free piston or plunger 21, slidably disposed within the bore of tubing 15. Lift gas flows from a source (not shown) through surface conduit 38 containing injection meter 33, check valve 36, motor valve 32 and casing valve 34 into an annulus chamber 19.

When the combination of surface back pressure at outlet check valve 28, weight of gas column in chamber 19, and the hydrostatic pressure of the liquid slug within the bore of tubing 15 reaches a specified value at gas lift valve 20*a*, gas is injected into chamber 19 through motor valve 32 for a preselected injection period determined by controller 31. When the gas pressure in chamber 19 increases to the opening pressure of gas lift valve 20*a*, gas is injected into tubing 15 below plunger 21. The liquid slug within tubing 15 is propelled upward by the energy of the expanding and flowing gas beneath plunger 21. Plunger 21 separates the liquid and gas minimizing fallback. The liquid slug is produced through wellhead 22, master valve 23, swab valve 24, main flow tee 25 into outlet conduit 39 and then through outlet check valve 28 to a production facility. Gas pressure within the bore of tubing 15 decreases as the liquid is produced which increases the gas injection rate through gas lift valve 20*a*. The gas pressure within chamber 19 drops to the closing pressure of gas lift valve 20*a*. The column of gas within tubing 15 below plunger 21 will still continue to expand even though gas lift valve 20*a* closes. Controller 31, a mechanical timer, is preferably set for an injection period slightly less than the time period during which gas lift valve 20*a* is open. If motor valve 32 remained open when gas lift valve 20*a* closes, gas pressure in chamber 19 would quickly build up to the opening pressure of gas lift valve 20*a* before the pumping cycle has been completed.

The opening pressure of gas lift valve 20*a* and the spread between opening and closing pressure of gas lift valve 20*a* is preselected such that the energy of the gas column below plunger 21 will be sufficient to displace the liquid slug from tubing 15 into the production facility and raise plunger 21 into bore 50 of plunger catcher and trip assembly 30 at the well surface. The energy of the gas column must be sufficiently dissipated when plunger 21 enters wellhead 22 that lubricator bumper subassembly 26 can absorb the momentum of plunger 21 and allow catcher and trip assembly 30 to engage and hold plunger 21 above tubing 15. Any gas remaining in tubing 15 escapes through main flow tee 25 and outlet conduit 39 to the production facility where the gas can be separated from the liquid and returned to the gas source (not shown).

Timer controller 31 directs gas pressure through conduit 37 to chamber 81 to shift piston 66 and operating shaft 67 to its first position after a preselected time interval has elapsed since motor valve 32 opened. This timer interval is selected to correspond with the time required for plunger 21 to travel from stop 16 to bore 50 of assembly 30 after motor valve 32 opens. Thus, timer controller 31 regulates both motor valve 32 and plunger catcher and trip assembly 30.

With plunger 21 trapped in catcher and trip assembly 30 and the pressure within tubing 15 decreased to backpressure at outlet check valve 28, a stabilization period occurs during which another liquid slug forms within tubing 15 above standing valve 13. Controller 31 is manually preset to release plunger 21 from catch and trip assembly 30 near the end of the stabilization period.

Plunger 21 then falls through the bore of tubing string 15 until it engages bumper spring 17 secured within tubing 15 by tubing stop 16. Tubing stop 16 is positioned above the working gas lift valve 20*a*.

The present invention is significantly improved over the prior art by controller 31 regulating both the opening of motor 32 which controls the injection of gas into chamber 19 and the holding of plunger 21 within catcher and trip assembly 30. The controller can be easily adjusted to vary the injection period and stabilization period for optimum production of formation fluids.

The previously described invention can be readily adapted for use in various types of oil and gas wells, water wells, or other wells requiring artificial lift of liquids. The previous description is only illustrative of some of the embodiments of the present invention. Changes and modifications will be readily apparent to those skilled in the art and may be made without departing from the scope of the invention which is defined in the claims.

What is claimed is:

1. An improved plunger lift system for use in a well having a wellhead, a tubing string disposed within a casing forming an annulus therebetween, lift gas supplied at the well surface, and means for injecting the lift gas from the well surface to within the bore of the tubing string at a location intermediate the ends of the tubing string, and a plunger adapted to reciprocate within the bore of the tubing string to separate lift gas from a liquid slug within the tubing string, wherein the improvement comprises:

a. means for catching and holding the plunger within the wellhead after the plunger has completed an upward stroke through the bore of the tubing string;
b. a timer controller regulating the interval during which lift gas is injected from the source to the annulus;
c. the same timer controller regulating the interval during which the plunger is held within the wellhead;
d. motor valve means regulating the flow of lift gas to the annulus;
e. the time controller opening and closing the motor valve means;
f. the means for catching and holding the plunger further comprising;
g. tubular means attached to the wellhead;
h. housing means extending radially from the tubular means;
i. a piston and operating shaft slidable within the housing means and having a first position holding the plunger within the wellhead; and
j. the timer controller directing operating fluid to move the piston to its first position at preselected time intervals after the timer controller opens the motor valve means.

2. An improved plunger lift system as defined in claim 1 wherein the operating fluid to move the piston and operating shaft is lift gas.

3. In a plunger lift system for wells having a tubing string extending downward from a wellhead, a plunger catcher and trip assembly, comprising:

(a) tubular means adapted for engagement with the wellhead and having a bore aligned with the bore of the tubing string;
(b) housing means extending radially from the tubular means;
(c) means disposed within the housing means for engaging the plunger when the plunger is within the tubular means;
(d) a piston slidably disposed within the housing means;
(e) an operating shaft slidably disposed within the housing means and attached to the piston;
(f) the operating shaft haviang a sufficient length that one end thereof can contact the engaging means;
(g) the operating shaft and piston having a first position in which the one end of the operating shaft contacts the engaging means and holds the engaging means whereby the plunger is trapped and held within the tubular means;
(h) means for supplying operating fluid to the housing means to move the piston and operating shaft to the first position.

4. A plunger catcher and trip assembly as defined in claim 3, further comprising:

(a) the housing means surrounding an opening in the wall of the tubular means;
(b) the engaging means partially projecting into the bore of the tubular means through the opening; and
(c) the engaging means holding the plunger within the tubular means when partially projected through the opening.
(d) a piston slidably disposed within the housing means;
(e) an operating shaft slidably disposed within the housing means and attached to the piston;
(f) the operating shaft having a sufficient length that one end thereof can contact the engaging means;
(g) the operating shaft and piston having a first position in which the one end of the operating shaft contacts the engaging means and holds the engaging means whereby the plunger is trapped and held within the tubular means;

5. A plunger catcher and trip assembly, comprising:

(a) tubular means adapted for engagement with a wellhead and having a bore which can be aligned with the bore of a tubing string;
(b) housing means extending radially from the tubular means;
(c) means for engaging a plunger when the plunger is within the tubular means;
(d) the tubular means having an opening surrounded by said housing means through which the engaging means can be partially projected into the bore of the tubular means;
(e) a piston slidably disposed within the housing means;
(f) an operating shaft slidably disposed within the housing means and attached to the piston;
(g) the operating shaft having a sufficient length that one end thereof can contact the engaging means and hold the engaging means partially projected through the opening in the tubular means;
(h) the operating shaft and piston having a first position in which the one end of the operating shaft contacts the engaging means and holds the engaging means partially extended into the bore of the tubular means whereby the plunger is trapped and held within the tubular means;
(i) means for supplying operating fluid to the housing means to move the piston and operating shaft to the first position.

6. A plunger catcher and trip assembly as defined in claim 5 wherein the operating fluid which moves the piston is the same fluid that lifts the plunger.

* * * * *

UNITED STATES PATENT AND TRADEMARK OFFICE

CERTIFICATE OF CORRECTION

PATENT NO. : 4,211,279

DATED : July 8, 1980

INVENTOR(S) : Kenneth M. Isaacks, North Glenn, Colorado

It is certified that error appears in the above—identified patent and that said Letters Patent is hereby corrected as shown below:

In the Abstract, line 9, "product" should read --production--.

In column 1, line 21, "Free" should read --A free--.

In column 1, line 40, "closes" should read --close--.

In column 1, line 49, "up and the" should read --up the--.

In column 1, line 63, "which" should read --but--.

In column 2, line 4, "and a" should read --and has a--.

In column 4, line 36, "up which" should read --up. This--.

In column 5, line 1, "outsided" should read --outside--.

In column 5, line 28, "Preferrably" should read --Preferably--.

In column 8, line 8, "haviang" should read --having--.

Signed and Sealed this

*Sixteenth* Day of *December 1980*

[SEAL]

*Attest:*

SIDNEY A. DIAMOND

*Attesting Officer*

*Commissioner of Patents and Trademarks*